US008418622B1

(12) United States Patent
Pham et al.

(10) Patent No.: US 8,418,622 B1
(45) Date of Patent: Apr. 16, 2013

(54) SHAPED CHARGE JET DISRUPTOR

(75) Inventors: James Pham, Randolph, NJ (US); Gregory Stunzenas, Pocono, PA (US); Tan Vuong, Hackettstown, NJ (US); Ernest Baker, Wantage, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 89 days.

(21) Appl. No.: 13/097,231

(22) Filed: Apr. 29, 2011

(51) Int. Cl.
*F42B 12/10* (2006.01)

(52) U.S. Cl.
USPC ..... 102/476; 102/306; 102/475

(58) Field of Classification Search ..... 102/476, 102/475, 306–310
See application file for complete search history.

(56) References Cited

U.S. PATENT DOCUMENTS

| | | | | | |
|---|---|---|---|---|---|
| 3,013,491 | A * | 12/1961 | Poulter | ..... | 102/310 |
| 5,320,044 | A * | 6/1994 | Walters | ..... | 102/475 |
| 6,619,176 | B2 * | 9/2003 | Renfro et al. | ..... | 86/51 |
| 6,925,924 | B2 * | 8/2005 | Baker et al. | ..... | 89/1.151 |
| 7,546,806 | B1 * | 6/2009 | Daniels et al. | ..... | 102/306 |
| 7,600,476 | B1 * | 10/2009 | Baker et al. | ..... | 102/476 |
| 7,752,972 | B1 * | 7/2010 | Baker et al. | ..... | 102/309 |
| 7,886,667 | B1 * | 2/2011 | Baker et al. | ..... | 102/495 |
| 8,272,330 | B1 * | 9/2012 | Gold et al. | ..... | 102/494 |
| 2003/0183113 | A1 * | 10/2003 | Barlow et al. | ..... | 102/476 |
| 2005/0188878 | A1 * | 9/2005 | Baker et al. | ..... | 102/306 |
| 2011/0232519 | A1 * | 9/2011 | Sagebiel | ..... | 102/309 |
| 2012/0304882 | A1 * | 12/2012 | Baum | ..... | 102/301 |

* cited by examiner

*Primary Examiner* — Michael David
(74) *Attorney, Agent, or Firm* — Henry S. Goldfine

(57) ABSTRACT

A simple, inexpensive, device and method of use thereof for disrupting the jet of a shaped charge and thereby significantly reducing the penetrating capability by over 90% thereof; thus providing a means to mitigate the damage caused by the premature or accidental jetting of the shaped charge. The device has a central support, along which radiate a plurality of increasing radius, generally hemi-circular, thin discs—such that the outline of the disc edges thereof form a cone that models the interior of the hollow open mouth of the shaped charge—importantly, the discs are staggered along the length of the central support. The device, which can be molded of inexpensive plastic, must be lodged fully within the hollow open mouth of the shaped charge at the time of the premature or accidental jetting—to provide the desired mitigation.

10 Claims, 8 Drawing Sheets

SECTION B-B

SECTION B-B

SHAPED CHARGE JET DISRUPTOR

FEDERAL RESEARCH STATEMENT

The invention described herein may be manufactured, used, and/or licensed by the U.S. Government for U.S. Government purposes, without the payment of any royalty therefore.

FIELD OF THE INVENTION

The present invention relates to a device and method of use thereof for disrupting the jet from a shaped charge, thereby provide a means for mitigating the potential damage due to an unintended or accidental discharge thereof.

BACKGROUND OF THE INVENTION

A shaped charge is an explosive device in which a shell called a liner, commonly a metal hollow cone or hemisphere (forming a hollow, open, "mouth"), which liner is surrounded by a high explosive charge, which charge is enclosed in a casing, which can be manufactured of steel, composites, aluminum or fiberglass, and usually with a detonator for the explosive charge located at the end opposite the hollow open mouth. When the explosive is detonated, a detonation wave is formed as a very high velocity jet that has great penetrative power, i.e. significant explosive momentum. Such devices, with such penetrative power, fulfill significant military and civil needs. The latter includes needs within the oil industry (such as detailed in U.S. Pat. Nos. 4,633,951, 4,683,943, 4,823,875, 5,775,426 and published U.S. Pat. Applications 2003/0037692 and 2005/0056459), ejector seat mechanisms, and also civil engineering work such as decommissioning of large structures.

For military applications, shaped charges were first developed after WWI as an anti-tank device—a device that has developed to include a generally cylindrical charge that lies flat against the target (to provide a direct detonation effect); a hollow conical mouth formed of a liner, to further channel the explosive force or "jet" and to increase the penetrative effect thereof; and an explosive charge on the other side of the liner; which charge is encapsulated within an overall housing. Typically, the jet will reach its terminal velocity within about 40 milliseconds, with an acceleration reaching about 25 million g. The pressure is so great the a velocity of more than 10,000 m/s is achieved—which creates an intense localized force that can have a devastating effect even against modern rolled homogenous armored targets (RHA targets)—causing both plastic deformation and hydrodynamic penetration of the target (i.e. imparting peak pressures in the target armor of up to about 100-200 GPa and temperatures of up to about 500-600 degrees Celsius or more).

Considering the potent forces unleashed by shaped charge devices, as described above, safety becomes a critical issue. A particular High Explosive Anti-Tank (HEAT) round is the Saab Bofors Dynamics AT4, which contains a high explosive, Octol (HMX/TNT)-filled, shaped charge. The fuse to detonate this HEAT round has an out-of-line detonator safety device to prevent accidental initiation, until impact. However, there is nothing to mitigate the jetting effect if the round were subjected to premature, pre-firing, shock—as if struck by an enemy projectile; or, if the round were subjected to an accidental stimulus—such as a fire, or accidental explosion, during production, transport, or storage.

U.S. Pat. No. 5,467,713 provides an ignition and safety device for a grenade projectile provided with a shaped charge insert; wherein such projectiles with shaped charge inserts are disclosed in U.S. Pat. No. 4,969,397). This safety device relates to an arrangement for a base-side impact fuse for such a grenade, which fuse includes a housing for attaching a spin-dependent safety element and an acceleration-dependent safety element for preventing arming of the fuse until the fuse has been subjected to launch acceleration force and to a given centrifugal force—which forces are only present upon launch. This device, as in the case of the Bofors Dynamics AT4 out-of-line detonator safety device, does not mitigate or prevent detonation, if the rounds are subjected to shock or to accidental stimulus.

U.S. Pat. No. 4,673,033 discloses a means of indicating if a string of shaped charges, lowered into a well shaft to complete the "drilling" thereof by perforating into the formation at the bottom of the well shaft, has successfully been discharged—prior to retrieval of the supposedly discharged charges out of the well shaft. This device functions by adding an additional shaped charge to the string of shaped charges, and detecting a signal at the top of the well head, if this extra charge has properly detonated; thereby, clarifying if there is any risk to retrieving any still live charge. Again, this device provides no mitigation or safety, with respect to any pre-use accidental initiation of the shaped charge.

Clearly there is a need in the art for a relatively low cost, simple means of mitigating the exceptional destructive effects of an unintended or accidental detonation of a shaped charge device.

SUMMARY OF INVENTION

The present invention addresses the need for a relatively inexpensive, simple method to mitigate the accidental detonation, i.e. accidental jetting, of a shaped charge device. Surprisingly, over 90 percent of the capability, i.e. penetrating power, from an accidentally jetting of a shaped charge can be dissipated by locating a disrupter of the present invention within the hollow open mouth thereof. The present inventive disrupter has a unique configuration that has been modeled to not only reduces the velocity of the shaped charge jet from 0.7 cm/microsecond to less than 0.1 cm/microsecond; but, to so disrupt the power of the jet so as to actually reduce the penetrating power by over 90%.

The disrupter of the current invention is preferably formed of a central support which in use extends centrally into the mouth of the shaped charge, such that the tip end thereof almost touches the central point of the liner that is closest to the detonator (i.e. the point of the liner which is most interior to the hollow open mouth); from which support, a plurality of generally hemi-circular thin plates extend generally perpendicularly therefrom (like wings); wherein the disc closest to the first tip end of the central support has the smallest radius and the radius of each disc thereafter toward the second end of the support is greater, such that the outline formed by the outer edges of the discs forms a cone shape—which cone shape corresponds to the inferior of the hollow open mouth of the shaped charge; and, importantly, where the plates are arranged along the length of the central support in a staggered fashion, i.e. one plate generally on one side then a spaced along the length of the support and one plate generally on the other side of the support—though the plates may overlap (as seen when viewed along the longitudinal axis of the support).

The central support may be in the form of a relatively thin member—such as a finger, i.e. a generally cylindrical support with a rounded end or alternatively, a relatively flat broadened support that uniformly narrows toward a rounded top, such as a thin, triangular in cross-section, wedge that has a rounded tip, whose base may extend part or all of the way to the periphery of the open end of the mouth. Preferably, there is a completely circular base plate at the base end of the central support, the diameter of which plate is just less than that of the opening of the mouth, such that the plate will effectively cover the mouth opening in such a way that it will be easy to fasten the plate, and disrupter extending therefrom, to the front edges of the mouth. The disrupter may be fastened by any convenient means to the front edges of the mouth—using clips, tape (such as duct tape), or the diameter of the circular base plate might be such as to provide a force fit into the shaped charge (but, if such is the case—a means of grasping the circular base plate must be provided to easily remove it from the mouth—and many such means are well known in the art). As detailed below, the means of holding the disrupter in place need not provide any significant force to keep it in place, the mere presence of the inventive disrupter within the hollow open mouth of the shaped charge, at the time of any unintended or accidental ignition thereof will provide the desired mitigation of the accidental jetting of the shaped charge.

Preferably the disrupter of the present invention has at least 4 generally 180 degree hemi-circular plates arranged along the length of the central support, in addition to the 360 degree, completely circular, base plate at the end thereof (to provide the discussed means to fasten the disrupter in place within the hollow open mouth of the shaped charge); though, the plates may be sections which are greater or less the 180 degrees in extent, i.e. hemi-circular. The plates may be sections that are about 10 to about 20 degrees more or less than the preferred 180 degree hemi-circular sections.

Preferably, the disrupter of the present invention is manufactured of a single material that is not fragile and will withstand the normal forces involved in the storage and transport of the shaped charge device. Potential materials of construction of the disrupter are plastic, metals, composites, or glass—preferably a low cost plastic material, most preferably a material which can be injection molded, such as ABS, acetal, K resin, nylon 6/6, PET, polypropylene, polyethylene, styrene, or TPE.

In an alternate preferred embodiment, the disrupter of the present invention may be manufactured as part of the storage/shipping container for the shaped charge device. The shaped charge device can be positioned within the storage/shipping container such that the central support with the staggeredly arranged hemi-circular plates of the disrupter, extends from the base or a wall of the storage/shipping container into the hollow open mouth of the shaped charge device and the device is firmly secured such that the disrupter will remain in such a functional position.

The nature of the subject invention will be more clearly understood by reference to the following detailed description and the appended claims.

DETAILED DESCRIPTION OF THE INVENTION

Figure 1:
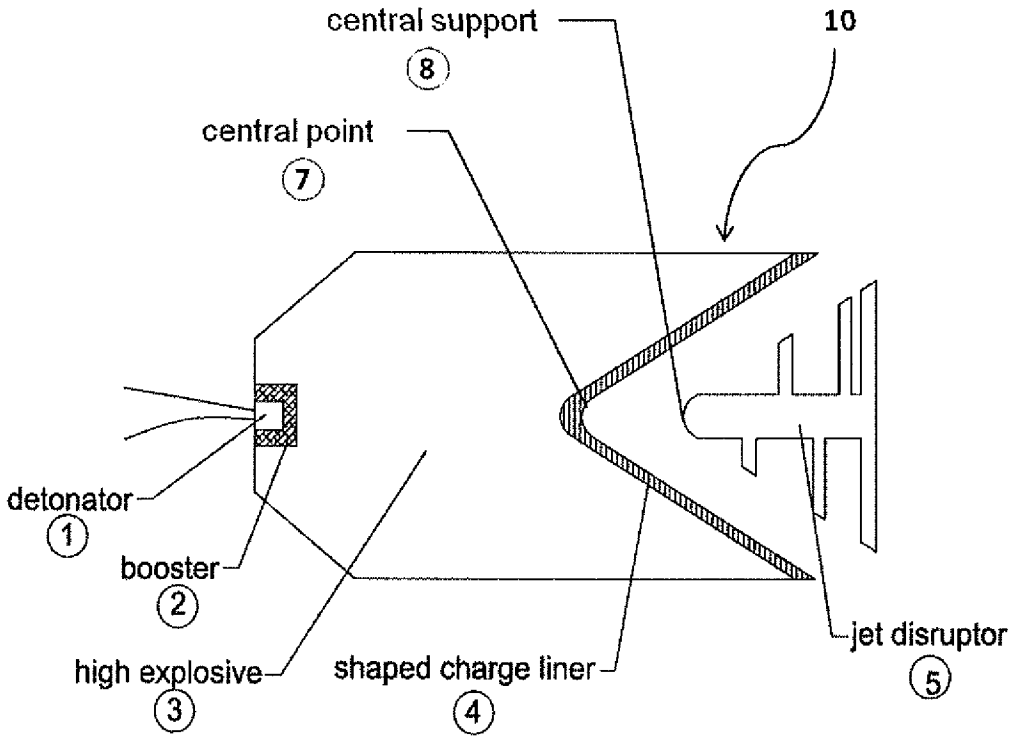
FIG. 1. is a cross-sectional schematic rendition of a typical shaped charge device with a disrupter of the present invention shown adjacent to the hollow open mouth thereof. In operation, the disrupter would be fully inserted within the mouth of the device.

Referring to FIG. 1, a schematic rendition (10) showing a typical shaped charge and a preferred embodiment of the present inventive disrupter (5), with, for clarity and illustrative purposes, the disrupter (5) spaced out of the hollow open mouth of the shaped charge—in use the disrupter would be fully lodged within the hollow open mouth of the shaped charge. Such that, in use, the rounded front end of the central support (8) would be adjacent to the central point (7) of the shaped charge liner (4). Also shown, are the high explosive (3) and the detonator (1) of the shaped charge—the two unnumbered lines entering the detonator (1) are the triggering wires.

Figure 2:
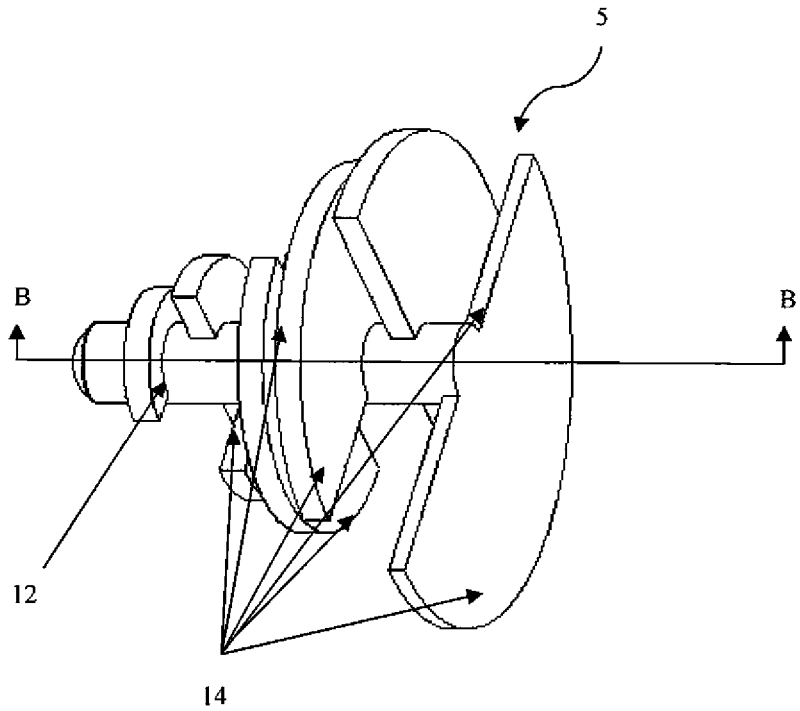
FIG. 2. is a perspective view of a preferred embodiment of a disrupter of the present invention, also showing a cross-section B-B thereof.
Figure 2:
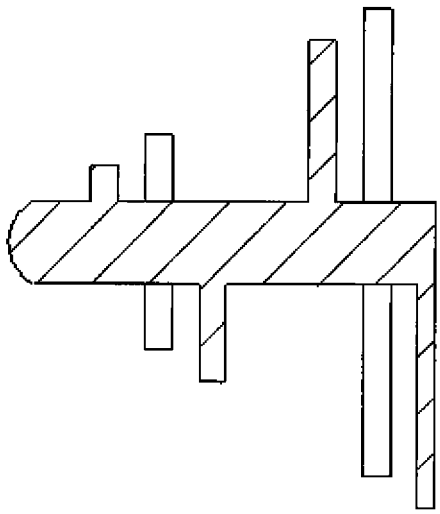

Referring to FIG. 2, a preferred embodiment of the inventive shaped charge jet disrupter (5), which is formed of a central support (12) which in use extends centrally into the mouth of the shaped charge, from which support a plurality of generally hemi-circular plates (14) extend generally perpendicularly therefrom, the radius of the plates increasing toward the mouth of the shaped charge to form a conical outline, and where the plates are arranged along the length of the support in a staggered fashion about the longitudinal axis of the support (which staggering can clearly be seen by referring to Section B-B of FIG. 2). As shown in FIG. 2, there are six (6) generally hemi-circular plates, staggered along the length of the central support (12)—however, for the purposes of achieving the desired mitigation of the jet from a shaped charge, four, or five, or six, or seven, or more such plates could be used. Further, while a hemi-circular plate is shown attached to the base of the central support in FIG. 2—alternatively, a completely circular plate could be attached thereto, in order to provide an improved means of securing the subject inventive disrupter in place within the hollow open mouth of the shape charge.

The central support (12) may be in the form of a relatively thin member as shown in FIG. 2, i.e. a generally cylindrical support with a rounded end, which end, when in use, is located adjacent to the central point of the liner, pointing toward the detonator located at the end of the shaped charge opposite the open mouth (as shown in FIG. 1). Or in alternative embodiments, the central support can be a relatively flat broadened support that uniformly narrows toward a rounded top, which top points towards the detonator located at the end of the shaped charge opposite the open mouth; such as illustrated in FIG. 3, showing a thin triangular in cross-section wedge that has a rounded tip; the base of which flat broadened support may extend part or all of the way to the periphery of the open end of the mouth, such that, if a complete 360 degree, circular, plate is present at the base of the central support, the base of such a thin triangular cross-section wedge, could extend part way across the diameter thereof, or fully across the diameter thereof (as shown in FIG. 3).

Figure 3:
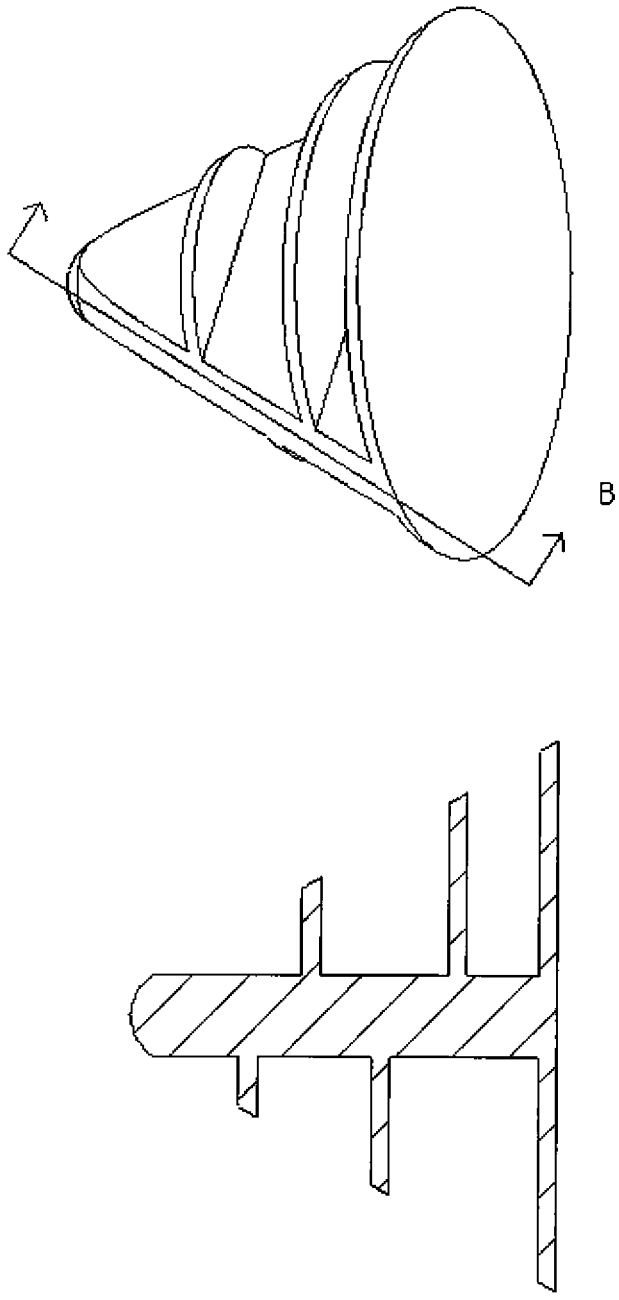
FIG. 3. is a perspective view of an embodiment of a disrupter of the present invention, also showing a cross-section B-B thereof.

As illustrated in FIG. 3, showing an alternative embodiment of the present invention, preferably, there is a completely circular base plate at the base of the central support, the diameter of which plate is just less than that of the opening of the mouth, such that the plate will effectively cover the hollow mouth opening in such a way that it will be easy to fasten the plate, and disrupter extending therefrom, to the front edges of the mouth. In use, the disrupter may be fastened by any convenient means to the front edges of the mouth—using metal or plastic clips, tape (such as duct or masking tape), or the diameter of the circular base plate might be such as to provide a force fit into the shaped charge (but, if such is the case a means of grasping the circular base plate must be provided to easily remove it from the mouth—and many such means are known in the art). In use, the present inventive disrupter must merely be located within the hollow open mouth of the shaped charge at the time the shaped charge is detonated as detailed below—it need not be fastened therein.

Preferably, as shown in FIG. 3, the disrupter of the present invention has at least 4 generally 180 degree hemi-circular plates staggered along the length of the central support, in addition to the 360 degree, completely circular, base plate provided as a means to fasten the disrupter to the front edge of the hollow open mouth of the shaped charge (which completely circular plate does not aid in and is not required for the desired mitigation effect). The plates may be sections greater or less than 180 degrees in extent. In fact, the plates may be sections that are about 10 to about 20 degrees more or less than the preferred 180 degree hemi-circular sections.

Preferably, the disrupter of the present invention is manufactured of a single material that is not fragile and will withstand the normal forces involved in the storage and transport of the shaped charge device. Potential materials of construction of the disrupter are plastic, metals, composites, or glass—preferably a low cost plastic material, most preferably a material which can be injection molded, such as ABS, acetal, K resin, Nylon 6/6, PET, polypropylene, polyethylene, styrene, or TPE.

In an alternate preferred embodiment, the disrupter of the present invention may be manufactured as part of the storage/shipping container for the shaped charge device. The shaped charge device can be positioned within the storage/shipping container such that the central support with asymmetrically arranged plates of the disrupter extends from the base or a wall of the storage/shipping container fully into the hollow open mouth of the shaped charge device and the device is firmly secured such that the disrupter will remain in such a functional position.

Figure 4:
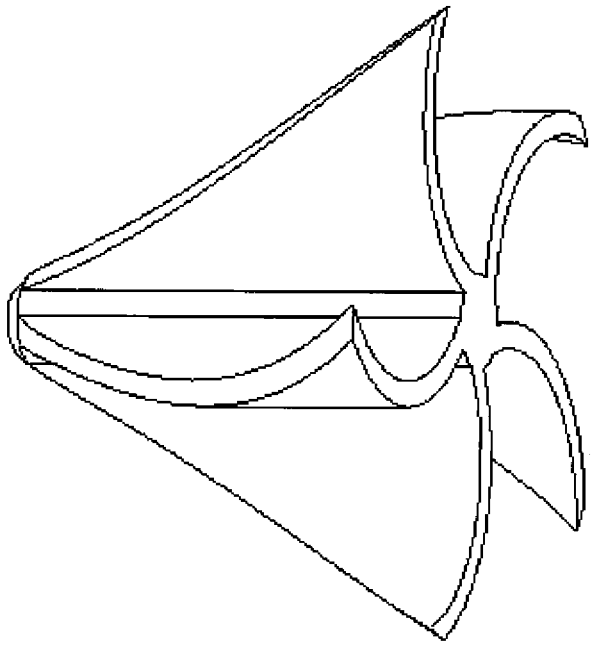
FIG. 4 is a perspective view of a pinwheel shaped alternative considered; but, discarded as not providing significant mitigation of the penetrating power of the shaped charge jet.
Figure 5:
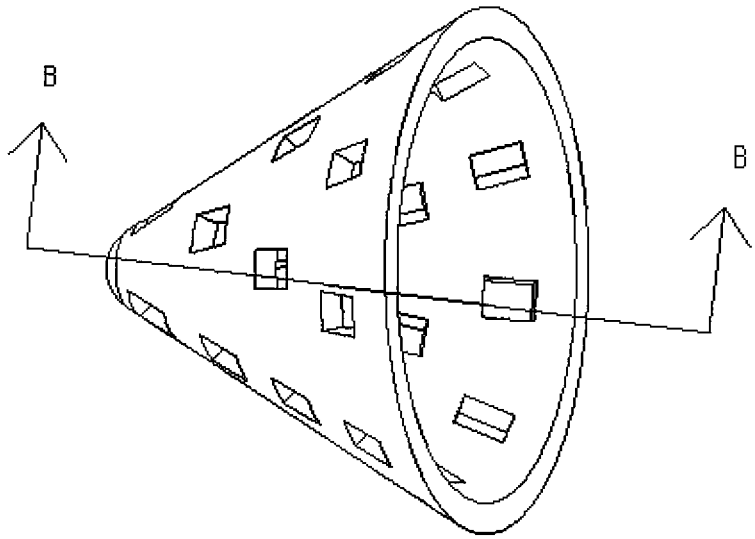
FIG. 5 is a perspective view of a cone shape with holes alternative considered; but, discarded as not providing significant mitigation of the penetrating power of the shaped charge jet. For clarity, a cross-section view of this cone shaped alternative is also shown.
Figure 5:
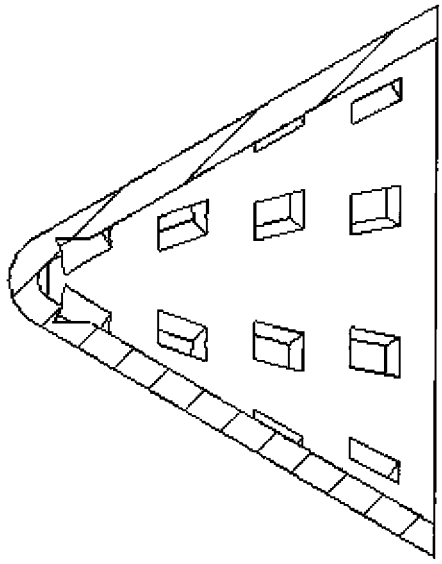
Figure 6:
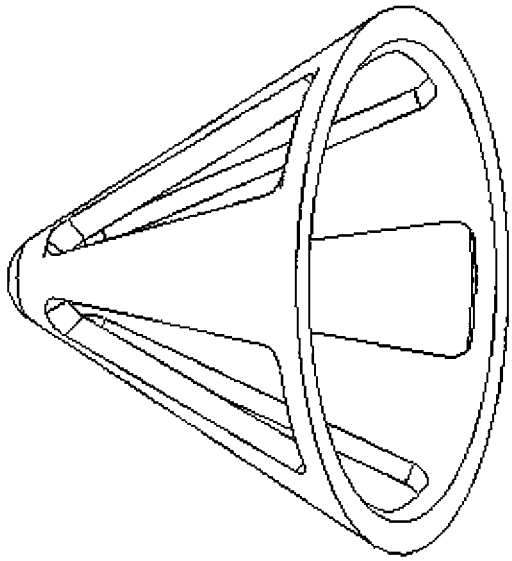
FIG. 6 is a perspective view of a cone shape with slots alternative considered; but, discarded as not providing significant mitigation of the penetrating power of the shaped charge jet.
Figure 7:
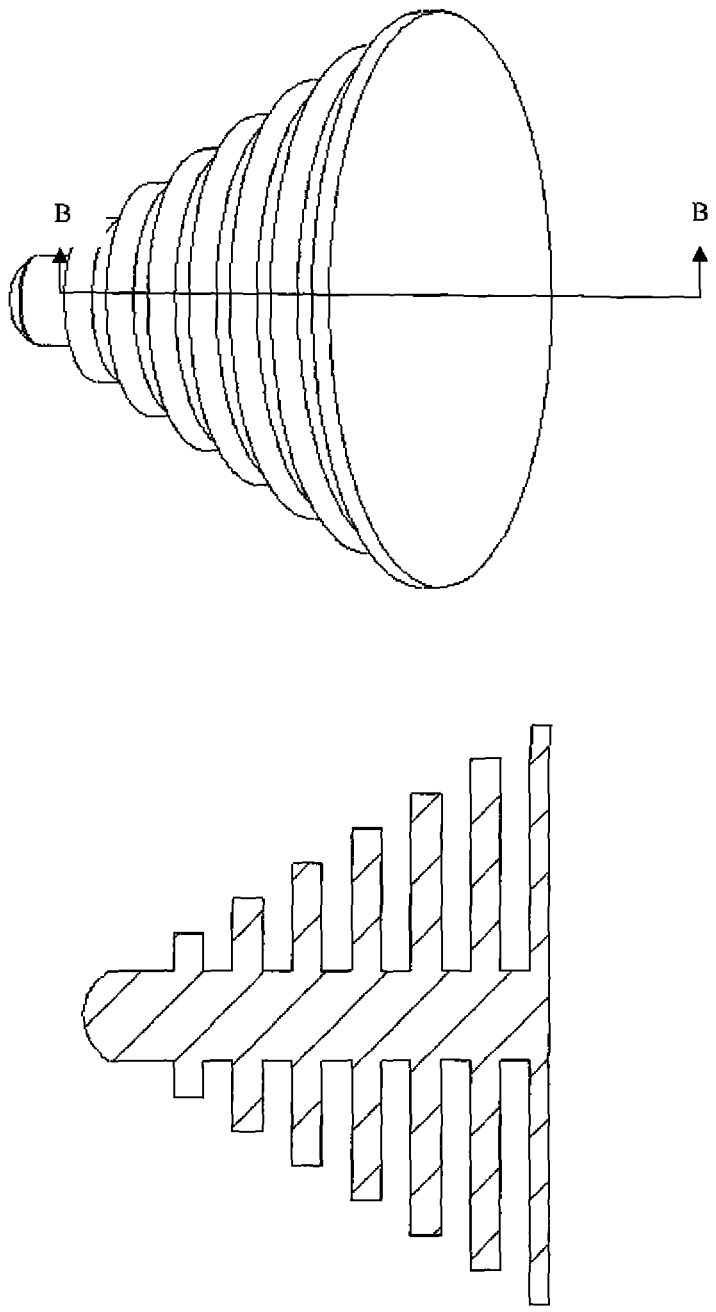
FIG. 7 is a perspective view of a cone shape, with a series of enlarging discs along the length thereof, alternative considered; but, discarded as not providing significant mitigation of the penetrating power of the shaped charge jet. For clarity, also shown with this alternative is a cross-section thereof. For clarity, a cross-section view of this cone shaped alternative is also shown.
Figure 8:
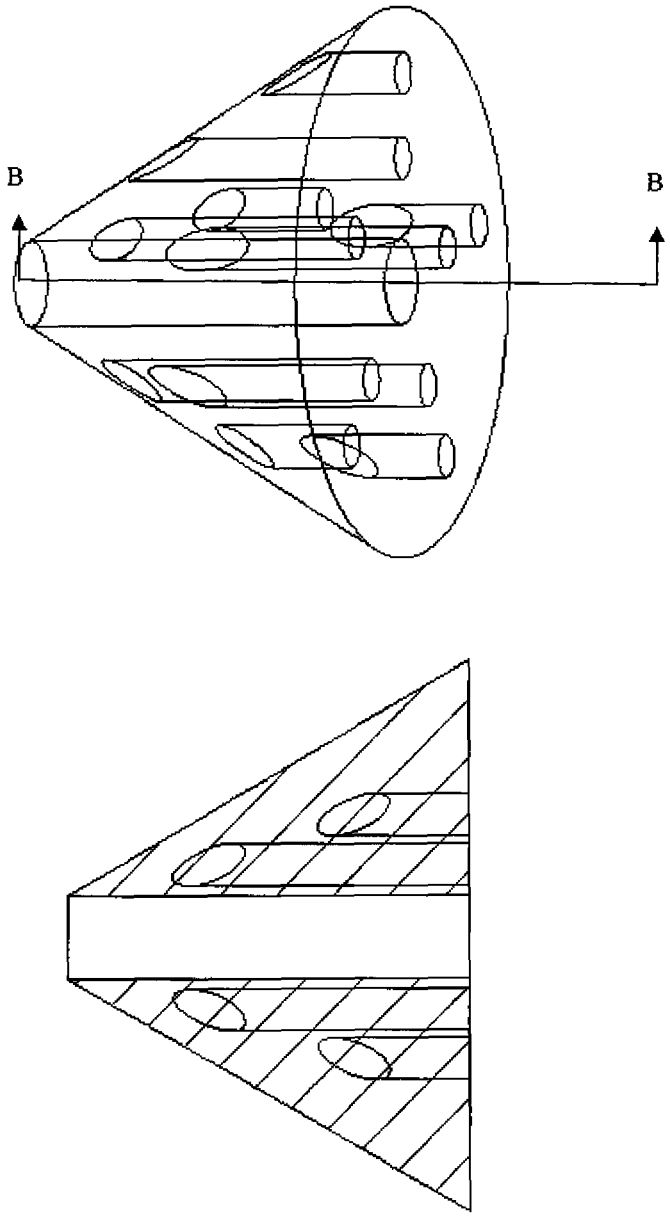
FIG. 8 is a clear, stylized, perspective view of a cone shape, with a plurality of holes therethrough, alternative considered; but, discarded as not providing significant mitigation of the penetrating power of the shaped charge jet. For clarity, also shown with this alternative is a cross-section thereof. For clarity, a cross-section view of this cone shaped alternative is also shown.

As modern finite element simulation software is precise, it was possible to eliminate various alternative disrupter embodiments that failed to reduce the momentum, i.e. penetrating power, of the shaped charge jet significantly, without costly experimentation. Particular embodiments that failed to model a significant reduction in penetrating power are shown in FIG. 4 (a pinwheel type shape); FIG. 5, (a cone shape with square shaped holes therethrough); FIG. 6 (a cone shape with elongated slots therethrough); FIG. 7 (a central support with a set of 360 degree plates, uniformly along the length thereof); FIG. 8 (a truncated solid cone with a series of cylindrical holes longitudinally therethrough). The modeling software used was a proprietary U.S. military program, 3D-ALE; however, this program and its results are very similar to and can be reproduced by using a commercially available program LS-DYNA®, available from Livermore Software Technology, Livermore, Calif.

The finite element modeling of the present invention has shown that the disruptive effect is completed by the at least 4 generally hemi-circular plates arranged in a staggered fashion along the length of the central support and generally perpendicular to that central support—the outline of the hemi-circular plates forming a cone, i.e. the radius of the plates increasing toward the base of the central support (with the largest radius plate being located at or near the base of the central support). Also, as preferred, the full 360 degree circular base plate can be located at the base of the central support, to provide a means to attach to that central support a closure to the front edge of the hollow open mouth of the shaped charge. As stated above, this 360 degree circular base plate adds little to the disruptive effect and is to provide a means to more easily secure the disrupter to the front edge of the hollow open mouth.

Experimental Results

A base line and two experiments with preferred embodiments of the subject inventive disrupter were conducted to demonstrate the efficacy of the inventive disrupter, i.e. the mitigation of the shaped charge jet by the inventive disrupter. In each case a typical military shaped charge, a M2A4, fifteen-pound shaped demolition charge was used—modified only to contain an alternate, qualified, insensitive explosive material. Specifically, while the M2A4 charge usually contains a 50 gram booster of Composition A3 and a 11.5-pound main charge of Composition B—in place of the Composition B, the main charge was replaced with the insensitive explosive, IMX-104. IMX-104 is a known and qualified, equivalent energy, replacement for Composition B—IMX-104 containing 2,4-dinitroanisole (DNAN), 3-Nitro-1,2,4-triazol-5-one (NTO) and RDX. Further, as is standard with the M2A4, a cylindrical fiber base slips onto the end of the charge to provide a 6-inch standoff distance. The cavity liner is a cone of glass versus the typical metal. And, the charge is $14\frac{15}{16}$ inches high and 7 inches in diameter, including the standoff.

In the base line case, a modified M2A4 (as detailed above) was placed hollow open mouth down directly on top of four (4), 3 inch thick, RHA witness plates and detonated. The penetration of the shaped charge jet was measured as 16.5 cm.

In the first test of a preferred embodiment of the disrupter of the present invention, the embodiment illustrated in FIG. 2 was tested—using the modified M2A4. The particular preferred disrupter embodiment was manufactured of Accura 60 plastic, a clear polycarbonate like epoxy, available from 3D Systems Corporation, Rock Hill, S.C. This disrupter was placed within the mouth of the modified M2A4 shaped charge, held in place using duct tape, and the shaped charge with disrupter inside was placed, hollow open mouth down, on four witness plates—exactly as was done in the base case (where only the presence of the disrupter was different). The penetration was measured at 1.45 cm—a reduction, i.e. mitigation of the penetrative power/effect, of about 91.2% from the base case.

In the second test of a preferred embodiment of the disrupter of the present invention, the embodiment illustrated in FIG. 3 was tested—using the modified M2A4. The particular disrupter was also manufactured of Accura 60 plastic. Again, as in the test of the first embodiment described above, this disrupter was placed within the mouth of the modified M2A4 shaped charge and the shaped charge with disrupter inside was placed, hollow open mouth down, on four (4), 3 inch thick, RHA witness plates—again, exactly as was done in the base case (where only the presence of the disrupter was different). The penetration was measured at 1.956 cm—a reduction, mitigation, of about 88.2% from the base case.

We claim:

1. A shaped charge jet disrupter comprising, (a) An elongated central support, with a first tip end and second base end;

(b) a plurality of general hemi-circular discs extending generally perpendicular from said central support, which discs are spaced along the length of the central support in a staggered manner;

(c) wherein the disc closest to the first tip end of the central support has the smallest radius and the radius of each disc thereafter toward the second end is greater, such that the outline formed by a outer edges of the discs forms a general cone shape;

(d) which general cone shape corresponds to the interior of the hollow open mouth of the shaped charge.

2. The shaped charge jet disrupter of claim 1, wherein there are at least 4 generally hemi-circular discs staggered along the length of the central support.

3. The shaped charge jet disrupter of claim 1, wherein the number of generally hemi-circular discs staggered along the length of the central support is selected from the group consisting of 4, 5, 6, and 7.

4. The shaped charge jet disrupter of claim 1, wherein there is a completely circular disc located at the second base of the elongated central support, which disc provides a means to secure the disrupter within the hollow open mouth.

5. The shaped charge jet disrupter of claim 1, wherein said disrupter is manufactured of a material selected from the group consisting of a plastic, a metal, a composite, and glass.

6. The shaped charge jet disrupter of claim 1, wherein said elongated central support is cylindrical in shape, with the first tip end thereof rounded.

7. The shaped charge jet disrupter of claim 1, wherein said elongated central support is a thin, triangular in cross-section, wedge that has a rounded tip.

8. The shaped charge jet disrupter of claim 7, wherein said wedge has a base end opposite to its rounded tip, which base end has a length that is just less than the inner diameter of the hollow open mouth of the shaped charge.

9. A method for disrupting and significantly mitigating the penetrative capability of a jet emitted from the generally hollow open mouth of a shaped charge, comprising, (a) placing within said generally hollow open mouth of said shaped charge a disrupter;

(b) wherein, said disrupter comprises an elongated central support, with a first tip end and second base end;

(c) a plurality of general hemi-circular discs extending generally perpendicular from said central support, which discs are spaced along the length of the central support in a staggered manner;

(d) wherein the disc closest to the first tip end of the central support has the smallest radius and the radius of each disc thereafter toward the second end is greater, such that the outline formed by the outer edges of the discs forms a cone shape;

(e) which cone shape corresponds to the interior of the hollow open mouth of the shaped charge; and (f) wherein the first tip end of the said central support is adjacent to the central point of the interior of hollow open mouth of the shaped charge;

(g) such that when the shaped charge is detonated, the disrupter will disrupt and significantly mitigate the penetrating force of the jet therefrom.

10. The method for disrupting and significantly mitigating the penetrative capability of a jet emitted from the generally hollow open mouth of a shaped charge of claim 9, wherein said disrupter is fastened to a container holding the shaped charge.

* * * * *